United States Patent [19]

Schultheiss

[11] Patent Number: 4,699,198

[45] Date of Patent: Oct. 13, 1987

[54] DISCHARGING DEVICE FOR A CONTINUOUS CASTER

[75] Inventor: Alfons Schultheiss, Engelsbrand, Fed. Rep. of Germany

[73] Assignee: Inresa Schultheiss GmbH, Engelsbrand, Fed. Rep. of Germany

[21] Appl. No.: 823,453

[22] Filed: Jan. 28, 1986

[30] Foreign Application Priority Data

Jan. 28, 1985 [DE] Fed. Rep. of Germany ..... 3502703

[51] Int. Cl.[4] ..... B22D 11/128; B22D 11/20

[52] U.S. Cl. ..... 164/150; 164/413; 164/442

[58] Field of Search ..... 164/442, 448, 150, 413

[56] References Cited

U.S. PATENT DOCUMENTS 4,119,138 10/1978 Stull ..... 164/448
4,590,985 5/1986 Honda et al. ..... 164/442 X
4,592,408 6/1986 Haissig ..... 164/442 X
4,602,669 7/1986 Haissig et al. ..... 164/442 X

FOREIGN PATENT DOCUMENTS 3148033 6/1983 Fed. Rep. of Germany .

*Primary Examiner*—Nicholas P. Godici
*Assistant Examiner*—J. Reed Batten, Jr.
*Attorney, Agent, or Firm*—Spencer & Frank

[57] ABSTRACT

A discharging device for a continuous caster has two three-phase motors as its drive member. For the discharging process, these three-phase motors selectively charge the drive mechanism of the drive shaft for the drive rollers in opposite directions. The three-phase motors are selectively connected with the drive mechanism via separate electromagnetic couplings and thus produce the forward and reverse movement of the casting profile. Simple additional devices permit fully automatic operation.

12 Claims, 3 Drawing Figures

DISCHARGING DEVICE FOR A CONTINUOUS CASTER

BACKGROUND OF THE INVENTION

The present invention relates to a discharging or drawing device for a continuous caster. More particularly, the present invention relates to a discharge or drawing device for a continuous metal caster of the type wherein the drive shaft of a drive or discharging roller, which is in engagement with the profile of the casting to be drawn, is charged or driven by a drive member (power source) via a drive mechanism so that the drive roller may be intermittently driven in opposite directions.

In the casting of metal by means of a continuous caster, and in order to provide a good quality casting, it is known to provide a drawing or discharge device for the caster which operates to provide intermittent withdrawal or drawing of the casting from the caster. In this mode of operation, the discharge device engages the profile or skin of the casting and intermittently applies a force to the casting in the drawing direction followed by a force in the opposite direction, i.e. toward the caster.

In such discharging devices of the prior art, a stepping motor is generally provided to produce the drawing movement for the profile to be drawn, e.g. a wire, rod, strip or pipe, with the aid of a drive roller. Such devices, however, require high expenditures for the electronic systems to control the stepping motor. Additionally, such a stepping motor is both expensive to acquire and to maintenance.

A discharge device for a horizontal continuous caster for steel is known (see e.g., Federal Republic of Germany DEOS No. 3,148,033) wherein two sets of profiled drive rollers are utilized, with each roller of both sets being provided with a separate drive motor, and with the respective sets of drive rollers being continuously driven in opposite directions. The two sets of rollers are mounted and controlled so that they selectively engage the casting profile at different times to provide the two directions for force on the casting. As can easily be appreciated, such an arrangement includes two independent roll stands, again resulting in high expenditure for acquisition and maintenance.

Also known are hydraulic tensioning and drawing devices. However, these have the drawback that the tensioning device must always move back in the open state and the time required for the return movement limits the total discharging speed. Moreover, this device produces the operating noises customary for hydraulic systems.

SUMMARY OF THE INVENTION

It is an object of the present invention to provide a simple, automated discharging device which does not have the above-mentioned drawbacks.

The above object is accomplished according to the present invention in that, in a discharging device for a continuous caster wherein a drive means drives, via a drive mechanism, the drive shaft of a drive roller which engages the profile of a casting to be drawn from a caster, two three-phase motors are provided as drive members, with the two motors charging the drive mechanism and the drive shaft in respective opposite directions via separate selectively actuatable electromagnetic couplings.

Such three-phase motors are structurally simpler than the stepping motors or the hydraulic drives used in the past and are easy to control. One three-phase motor is provided for the forward movement and one for the reverse movement, with their motion being transferred to the drive shaft with a translation or step-down ratio which may be different for both motors. During the entire removal or discharge period, the two motors remain constantly switched on.

According to one feature of the invention, a second shaft is resiliently mounted parallel to the drive shaft and each shaft is provided with one of a pair of facing, cooperating rollers which enclose the profile to be drawn between them. Preferably, the two shafts are provided with a plurality of pairs of discharging rollers accommodating various profiles, with the pairs of rollers being mounted so that they can be displaced laterally on the shafts and thus permit a very quick change of profiles.

According to a further feature of the invention, the drive shaft is coupled with a path or angular displacement sensor whose information is transferred, together with other production specific data, to a common electronic control so that suitable programming permits a fully automatic discharging process.

DETAILED DESCRIPTION OF THE PREFERRED EMBODIMENTS

Figure 1:
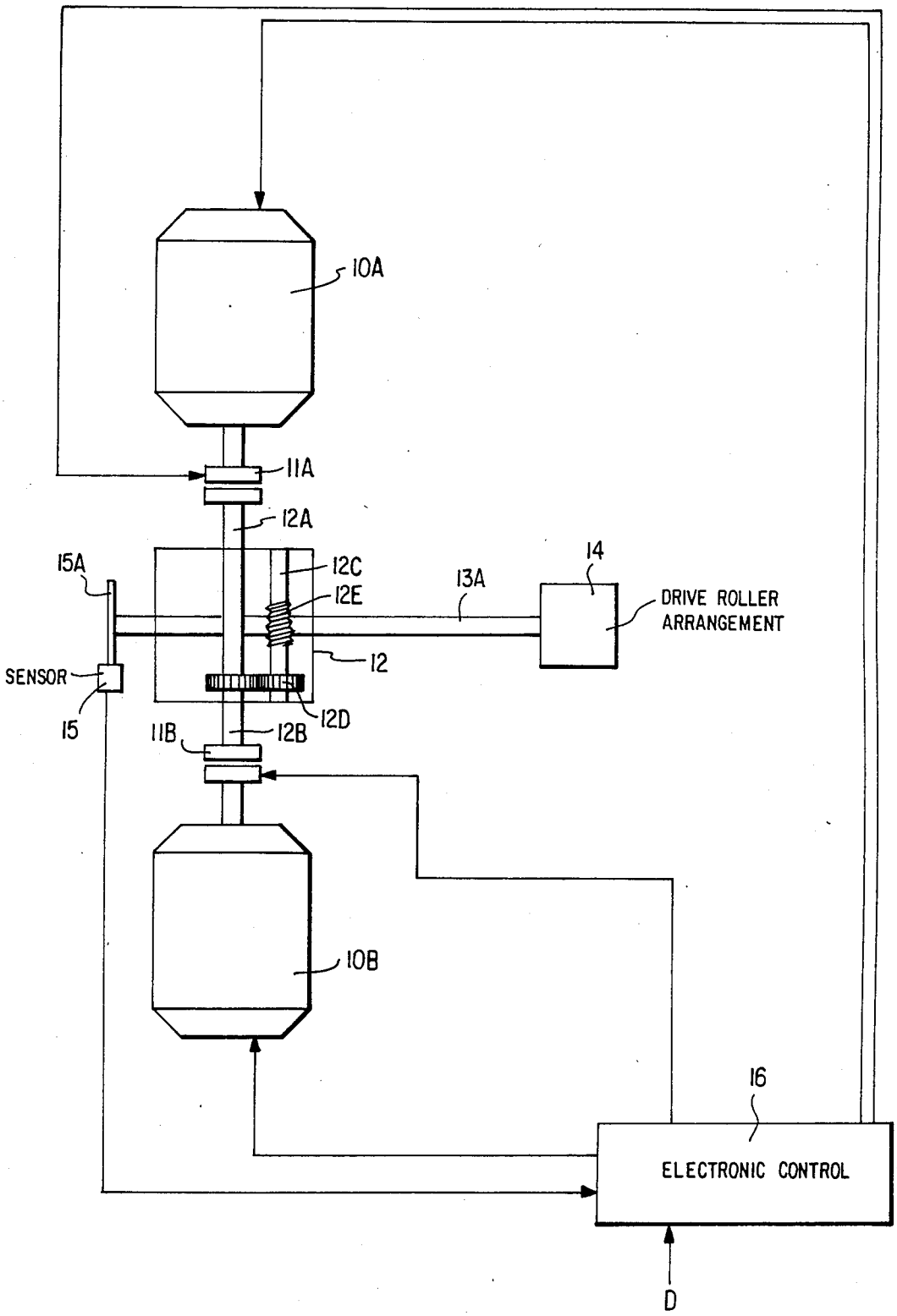
FIG. 1 is a schematic total view of the discharging device according to the invention.

Referring now to FIG. 1, there is shown a drive shaft 13A for a drive roller arrangement 14 (FIG. 2) connected to one end of the drive shaft 13A which, in a known manner, produces the forward and backward discharging movement for a casting being discharged from a continuous caster (not shown). The drive shaft 13A is itself driven by a drive mechanism or transmission 12 having two power input shafts 12A and 12B.

In the schematically illustrated embodiment of the drive mechanism or transmission 12, the two input shafts 12A and 12B are opposite ends of a common rotatably mounted shaft which is coupled to a further rotatably mounted shaft 12C via a pair of gears 12D. The shaft 12C is turn forms a worm gear drive 12E with the output shaft 13A so as to drive the shaft 13A with a desired step down ratio, e.g., a 105:1 ratio. It should be noted however, that any know transmission which will provide a desired step-down ratio between two input shafts and a single output shaft may be utilized. Moreover, if desired, the drive mechanism 12 may, in a known manner, include components which couple two separate input shafts to a common output shaft with different step-down ratios.

Power is supplied to the drive mechanism 12 to rotate drive shaft 13A by two three-phase motors 10A and 10B, which are selectively coupled with the input shafts 12A and 12B, respectively, of the drive mechanism 12 by means of respective electromagnetic couplings 11A and 11B. Drive mechanism 12, and the coupling of the shafts 12A and 12B driven by the three-phase motors 10A and 10B respectively, are designed such that at given directions of rotation of the three-phase motors 10A and 10B, coupling of one three-phase motor to its respective input shaft produces an advancing movement of the casting profile engaged by the roller arrangement 14, and coupling of other three-phase motor to its respective input shaft produces a return or reverse movement of the same casting profile.

At its other end, the discharging or drive shaft 13A is provided with a coded disc 15A which cooperates with a sensor 15 so as to determine the respective position or angular displacement of the drive shaft 13A and thus of the linear position or travel of the casting, e.g., a rod, whose profile is engaged by the roller arrangement 14. The output signals from the sensor 15 are fed to an electronic control device 16, preferably a programmed microprocessor, to which are additionally fed, via a data input D, the production specific parameters for the casting process, such as, for example, metal temperature, cooling temperature of the casting mold and the desired value for the heating energy. As shown, the electronic control 16 is provided with control lines for the two three-phase motors 10A and 10B and for the two couplings 11A and 11B, which are then activated in dependence on the respectively employed program. Moreover, the electronic control 16 is provided with control lines (not shown) which lead to a heat generator and to a cooling water flow control valve.

Figure 2:
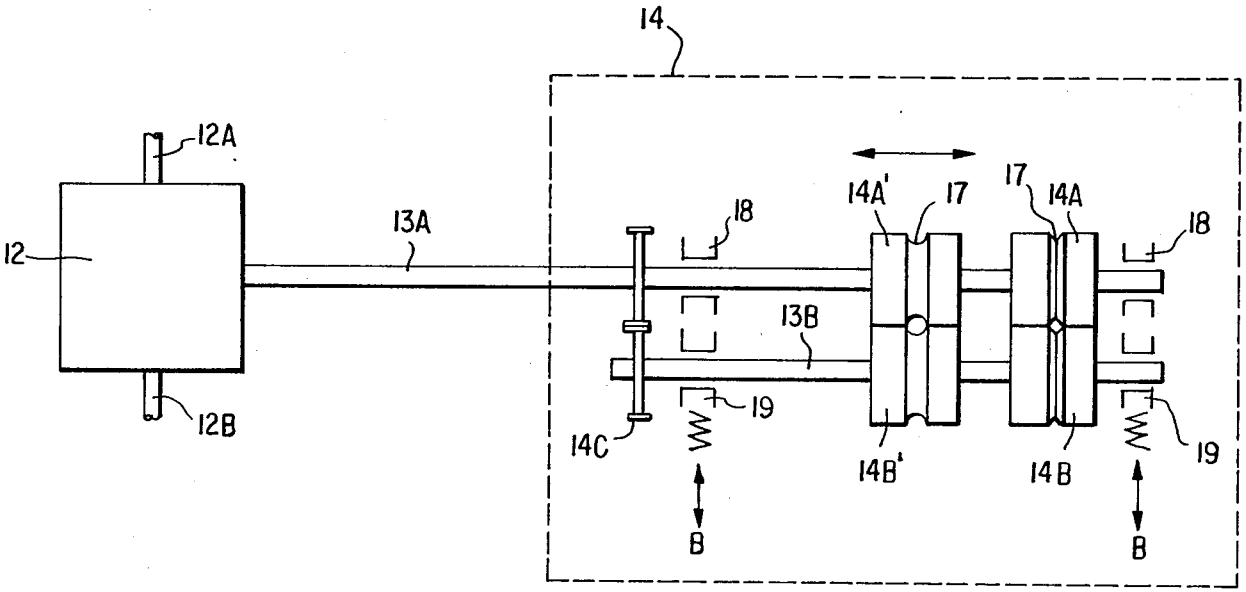
FIG. 2 is a schematic detail view of the arrangement of the discharging roller arrangement of FIG. 1.

The preferred arrangement of the discharging or drive roller arrangement 14 is schematically illustrated in FIG. 2. As shown, a second shaft 13B is arranged parallel to drive shaft 13A and is driven by drive shaft 13A via a pair of gears 14C so that shaft 13B rotates in the opposite direction from drive shaft 13A. Each of the shafts 13A and 13B has at least one roller of a pair of rollers 14A–14B or 14A'–14B' mounted thereon for rotation therewith. As shown each pair of rollers has a central circumferential groove 17 which is configured to correspond to the spatial shape of the casting profile to be drawn. In the illustrated embodiment, two pairs of rollers 14A–14B and 14A'–14B' are provided, with each pair of rollers having grooves 17 which correspond to a different profile shape and with the pairs of rollers being mounted on the two shafts 13A, 13B, so that they are laterally displaceable. By displacing the pairs of discharging rollers 14A–14B and 14A'–14B' on the shafts 13A and 13B, it is possible to quickly exchange profiles.

Preferably, as indicated in FIG. 2, the shaft 13A is rotatably mounted in a pair of bearings 18 which, in a conventional manner, are fixedly mounted in a support housing, while the shaft 13B is rotatably mounted in bearings 19 which are mounted in the support housing such that the shaft 13B is resiliently mounted so as to be able to perform an escape movement in the direction, as indicated by double arrows B, perpendicular to the longitudinal axis of the shaft 13B. Due to this resilient mounting, the shaft 13B is able to adapt itself to differences in the thickness of the material of the casting, i.e., a profile rod or wire as shown.

Figure 3:
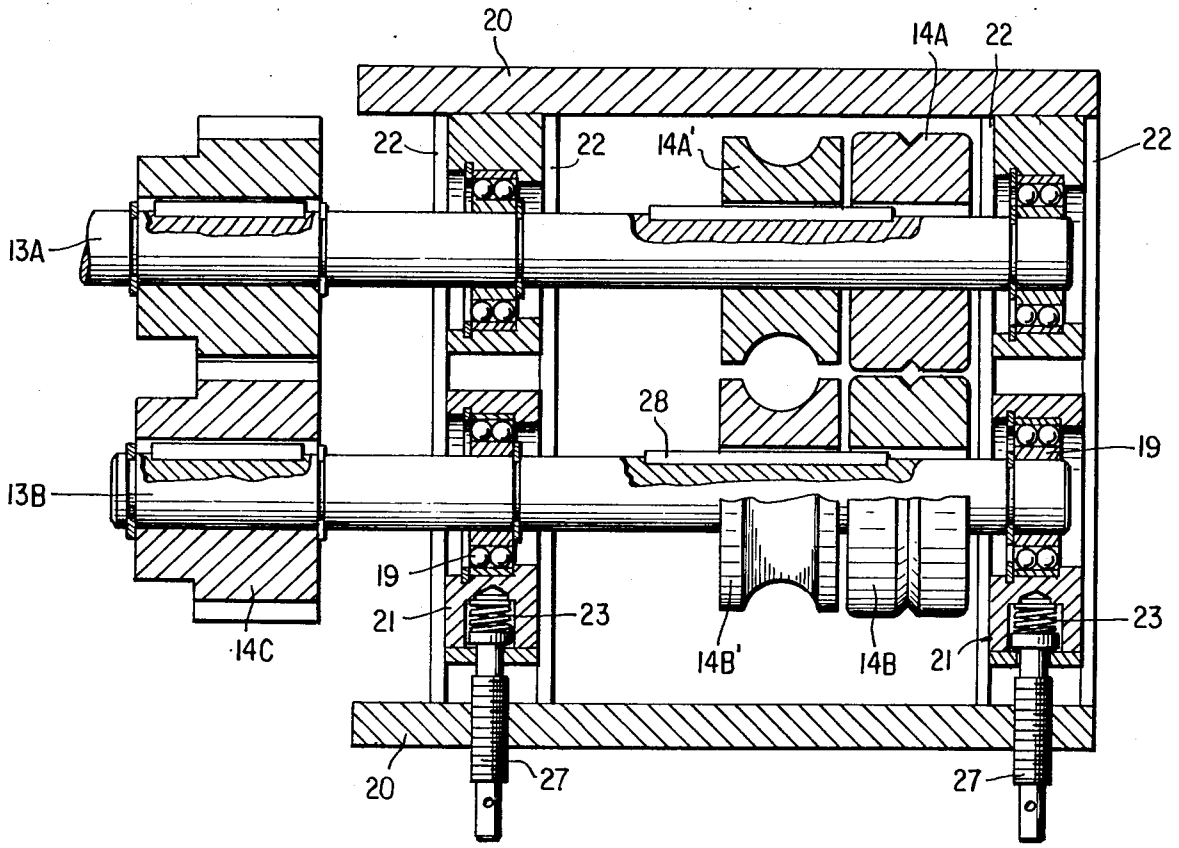
FIG. 3 is a cross-sectional view of a preferred arrangement of the discharging roller arrangement shown in FIG. 2.

Turning now to FIG. 3, there is shown a cross-section of a preferred embodiment of the discharging or drive roller arrangement 14 schematically shown in FIG. 2, wherein the same reference numerals are used to identify the same parts. As shown in this figure, the shaft 13A is rotatably mounted in a pair of bearing 18 which are mounted in a support housing 20 so that they are fixed in place. However, as indicated above, the bearings 19 for the shaft 13B are mounted in the housing 20 so that, while they are secured against lateral movement, i.e., in a direction parallel to the longitudinal axis of the shaft 13B, they can resiliently move, to a limited extent, in the direction perpendicular to the longitudinal axis of the shaft 13B. This is achieved in that each support block 21 for the bearings 19 is mounted so that it can move within a respective channel formed by a respective pair of support members 22 against the force of a spring 23 which normally urges the respective block 21 in a direction toward the shaft 13A. As shown, each spring 23 is disposed within a recess formed in the respective block 21 and is mounted on the end of a bolt 27 which is adjustably secured to the housing 20.

As further shown in FIG. 3, each of the rollers 14B, 14B' is secured on the shaft 13B for rotation therewith by means of a key 28 which is disposed in the surface of the shaft 13B and engages in a corresponding recess formed in the inner circumferential surface of the rollers. However, in the illustrated embodiment the rollers 14B and 14B' are not secured against lateral movement along the shaft 13B. The rollers 14A and 14A' are similarly secured on the shaft 13A, so that the pair of rollers 14A–14B' or 14A'–14B' which is desired for the particular profile being drawn may be easily moved to the operating position shown by the pair of rollers 14A'–14B' in FIG. 3.

It should be noted that the specifically disclosed discharge device, including the roller arrangement shown in FIG. 3 is particularly designed to be used in a continuous vertical caster of the type used for example for the casting of precious metals. In such a device, the drawing speed of the pair of drive rollers would be, for example, approximately 336 mm/min and the profiles formed by the roller pairs have a diameter in the order 5–10 mm for wire and 18 mm–37.5 mm for tubing.

The discharging device according to the present invention operates as follows:

Initially, the empirically determined data for the forward and return movements are fed to the control 16 via input D and the three-phase motor provided for the forward movement, for example, motor 10A, is coupled to shaft 12A of drive mechanism 12 by actuation of the associated coupling 11A, whereupon the discharging movement of the casting begins. The vertical discharging path or linear movement of a casting engaged by a pair of rollers 14A–14B or 14A'–14B' is measured or detected by the path sensor 15 in that it counts markers on the coded disc 15A and transmits this count to the control 16 wherein it is compared with a stored desired count value. When this desired count value is reached, other processing procedures, for example, the return movement of the casting, are initiated, in that coupling 11A is released and instead coupling 11B is actuated so as to couple the three-phase motor 10B to the input shaft 12B of drive mechanism 12 and cause the drive shaft 13A to be rotated in the opposite direction. During the return movement as well, the sensor 15 reports the length of this return movement to the control 16 where it is compared with a stored desired value for the return movement.

Once the most favorable processing data have been determined for a given material and a given profile, this permits practically fully automatic operation of the discharging device.

It will be understood that the above description of the present invention is susceptible to various modifications, changes and adaptations, and the same are intended to be comprehended within the meaning and range of equivalents of the appended claims.

What is claimed is:

1. In a discharging device for a continuous caster including drive roller means for engaging a profile of a casting to be drawn from a caster, a drive shaft for said roller means, and drive means, including a power source and means for coupling said power source to said drive shaft, for selectively driving said drive shaft in either of two opposite directions; the improvement wherein said power source includes first and second three-phase motors which are continuously rotating during a discharge process; and said means for coupling includes a drive mechanism connected to said drive shaft to rotate same and having first and second input shafts which each cause said drive shaft to rotate in a respective one of said two opposite directions and which are each associated with a respective one of said motors, and first and second electromagnetic couplings for selectively coupling each of said motors to the associated one of said input shafts.

2. A discharging device as defined in claim 1 wherein said drive mechanism includes components which effect a step-down ratio between said input shafts and said drive shaft.

3. A discharging device as defined in claim 2, wherein said drive mechanism includes components which effect a different step-down ratio for said two opposite directions of rotation of said drive shaft.

4. A discharging device as defined in claim 1 wherein said drive roller means comprises: a second shaft; means for rotatably mounting said second shaft in parallel with said drive shaft; first and second rollers disposed adjacent each other so as to engage the profile of a casting therebetween, with said first and second rollers being mounted respectively on said drive shaft and on said second shaft for rotation therewith; and gear means for coupling said second shaft to said drive shaft so that said drive shaft and said second shaft rotate in opposite directions.

5. A discharging device as defined in claim 4, wherein said means for rotatably mounting said second shaft includes means for resiliently mounting said second shaft for resilient movement in a direction perpendicular to the longitudinal axis of said drive shaft.

6. A discharging device as defined in claim 4, further comprising at least one further pair of adjacent rollers disposed on said drive and said second shafts; and wherein the rollers of said further pair and of said first and second rollers are laterally displaceable on said drive and second shafts.

7. A discharging device as defined in claim 1, further comprising means, coupled to said drive shaft, for sensing the angular displacement of said drive shaft and for providing a corresponding output signal.

8. A discharging device as defined in claim 7 wherein said means for sensing includes a coded disc fixedly mounted on said drive shaft, and a sensor for sensing the code on said disc.

9. A discharging device as defined in and claim 7, further comprising a common electronic control means, which is responsive to said output signals from said means for sensing, for controlling said three-phase motors and said couplings.

10. A discharging device as defined in claim 9, wherein said electronic control means contains further production specific data, including metal temperature, cooling temperature of the casting mold and the desired value for the heating energy.

11. A discharging device as defined in claim 10, wherein said electronic control means includes a programmed microprocessor, and said data constitute the operating data for said microprocessor.

12. In a discharging device for a continuous caster including drive roller means for engaging a profile of a casting to be drawn from a caster, a drive shaft for said roller means, and drive means, including a power source and means for coupling said power source to said drive shaft, for selectively driving said drive shaft in either of two opposite directions; the improvement wherein said power source includes first and second three-phase motors which are continuously rotating during a discharge process; and said means for coupling includes a drive mechanism connected to said drive shaft to rotate same and having first and second input shafts which each cause said drive shaft to rotate and which are each associated with a respective one of said motors, and first and second electromagnetic couplings for selectively coupling each of said motors to the associated one of said input shafts to cause said drive shaft to rotate in a respective one of said two opposite directions.

* * * * *